United States Patent [19]

Bronnvall

[11] Patent Number: 4,629,869

[45] Date of Patent: Dec. 16, 1986

[54] SELF-LIMITING HEATER AND RESISTANCE MATERIAL

[76] Inventor: Wolfgang A. Bronnvall, Hallandsgatan 10, S-25252 Helsingborg, Sweden

[21] Appl. No.: 631,550

[22] PCT Filed: Nov. 8, 1983

[86] PCT No.: PCT/SE83/00382

§ 371 Date: Jul. 12, 1984

§ 102(e) Date: Jul. 12, 1984

[87] PCT Pub. No.: WO84/02048

PCT Pub. Date: May 24, 1984

[30] Foreign Application Priority Data

Nov. 12, 1982 [SE] Sweden ..... 8206442

[51] Int. Cl.[4] ..... H05B 3/10

[52] U.S. Cl. ..... 219/553; 219/505; 219/528; 219/549; 252/511; 338/225 D

[58] Field of Search ..... 219/504, 505, 528, 543, 219/544, 549, 553; 338/22 R, 225 D, 214; 29/611; 204/159.17; 252/511

[56] References Cited

U.S. PATENT DOCUMENTS

| | | | |
|---|---|---|---|
| 3,243,753 | 3/1966 | Kohler | 338/31 |
| 3,673,121 | 6/1972 | Meyer | 252/511 |
| 4,188,276 | 2/1980 | Lyons et al. | 204/159.17 |
| 4,200,973 | 5/1980 | Farkas | 29/611 |
| 4,304,987 | 12/1981 | van Konynenburg | 219/553 |
| 4,388,607 | 6/1983 | Toy et al. | 338/225 D |

FOREIGN PATENT DOCUMENTS

| | | |
|---|---|---|
| 2103319 | 1/1974 | Fed. Rep. of Germany . |
| 2634931 | 5/1977 | Fed. Rep. of Germany . |
| 85642 | 2/1936 | Sweden . |
| 181635 | 3/1936 | Switzerland . |
| 675752 | 7/1952 | United Kingdom . |

OTHER PUBLICATIONS

F. Bueche, "A New Class of Switching Materials", *J. Appl. Phys.,* vol. 44, No. 1, Jan. 1973.

J. Meyer, "Glass Transition Temperature as a Guide to Selection of Polymers Suitable for PTC Materials", *Polymer Engineering and Science,* vol. 13, No. 6, Nov. 1973.

*Primary Examiner*—Volodymyr Y. Mayewsky

*Attorney, Agent, or Firm*—Browdy and Neimark

[57] ABSTRACT

A self limiting electrical heating device with an electrical resistance material the resistivity of which is changed by more than a power of (10) within a predetermined, narrow temperature interval and which is arranged between electrical conductors connectable to a voltage source, the conductors and the resistance material being enclosed in an electrically insulating cover. The electrical resistance material (2) comprises: (1) an electrically relatively non-conducting crystalline, monomeric substance which melts within or near the predetermined, narrow temperature interval and which constitutes the outer phase, (2) particles of one or more electrically conducting materials(s), distributed in the non-conducting material, (3) one or more non-conducting powdered or fibrous fillers, which are insoluable in the non-conducting material and which have a considerably higher melting point than this material, similarly distributed in the non-conducting material, whereby the weight ratio between components (1) and (3) is from 10:90 to 90:10.

19 Claims, 6 Drawing Figures

SELF-LIMITING HEATER AND RESISTANCE MATERIAL

FIELD OF INVENTION

This invention relates to self-regulating electrical heating devices with electrical resistance materials the resistivity of which is changed by more than a power of 10 within a predetermined narrow temperature interval.

BACKGROUND

Known electrical heating devices which, after reaching a critical temperature, rapidly decrease their output without the help of thermostatic regulation are based on two or more conductors and an intermediate resistance material, the resistivity of which starts to increase steeply at the critical temperature. Such materials are called PTC-materials (Positive Temperature Coefficient).

Known PTC-materials for self-limiting heating devices consist of crystalline polymers with conducting particles distributed therein. The polymers can be thermoplastic or crosslinked. In U.S. Pat. No. 3,243,753 the steep increase of the resistivity is explained by the expansion of the polymer leading to interruption of the contact between the conducting particles. In U.S. Pat. No. 3,673,121 the PTC effect is claimed to be due to phase changes of crystalline polymers with narrow molecular weight distribution.

According to J. Meyer, Polymer Engineering and Science, Nov. 1973, 462–468, the effect is explained by an alteration of the conductivity of the crystallites at the critical temperature.

Common for the known PTC-materials is that the resistivity alone is changed greatly above the critical temperature while the other physical properties generally remain unchanged. The temperature range in which the resistivity increases by a power of 10 is usually 50°–100° C. However, for many applications it is not satisfactory that the reduction of the power per degree is so small and that it is not possible to freely choose the temperature interval for the steep increase of the resistivity.

In an article by F. Bueche in J. of Applied Physics, Vol. 44, No. 1, January 1973, 532–533, it is described how, by combining several percent by volume of conducting particles in a semicrystalline matrix, a highly temperature-dependant resistivity is obtained. This resistivity is changed considerably in a small temperature interval around the crystal melting temperature. As the non-conducting matrix various hydrocarbon waxes are used. According to the article, it is also possible to add so-called "mechanical stabilizers", consisting of polymers soluble in the wax, whereby for obtaining good results, it is stated to be important that the wax and the polymer are soluble in each other, which means that only one phase may exist.

SUMMARY

The present invention relates to a self-limiting electrical heating device with an electrical resistance material, the resistivity of which is changed by more than a power of 10 within a pre-determined narrow temperature interval and which is arranged between electrical conductors connectable to a voltage source, the conductor and the resistance material being enclosed in an electrically insulating cover. The device is characterized in that the electrical resistance material consists of (1) and electrically, relatively non-conducting crystalline, monomeric substance which melts within or near the predetermined narrow temperature interval and which forms the outer phase, (2) particles of one or several electrically conducting materials distributed in the non-conducting substance, (3) one or several non-conducting fillers in the form of powder, flakes or fibres, which are insoluble in the non-conducting material and which have a considerably higher melting point than this material similarly distributed in the non-conducting material, whereby the weight ratio between the components (1) and (3) is from 10:90 to 90:10.

Preferably, the weight ratio between the components (1) and (3) shall be between 10:90 and 50:50.

The invention also relates to the electrical resistance material as such.

DETAILED DESCRIPTION OF EMBODIMENTS

Figure 1:
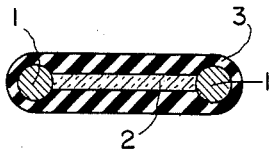
FIG. 1 is a cross section of a heating cable according to the present invention.

The change in resistivity per degree Celsius for the electrical resistance material according to the invention is smaller at lower temperatures than within the predetermined narrow temperature interval. The resistivity of the previously known compositions of meltable monomeric substances and conducting particles is not constant within temperature ranges above the interval where the resistivity is rapidly increasing, but drop from its maximum by up to a power of 10 per 20° C. According to the present invention, it has now been found that the slope below the critical temperature interval is less steep and the decrease above is only very small if the mixtures contain one or several non-conducting fillers which are insoluble in the non-conducting material. It is important that this decrease above is as small as possible, since a large decrease may cause the resistivity to be so low that the device will develop power again.

It has further been found that the power development in the compositions should not exceed 5 watts per $cm^3$, preferably not exceed 2 watts per $cm^3$ in order to avoid electrical breakdown. To be able to design heating devices in practice, suitable for connection into mains voltages of 110 V or 220 V, the resistivity values of the compositions should be greater than $10^3$ ohm cm, preferably greater than $10^4$ ohm cm. The compositions according to the invention can easily be adjusted to the desired high resistivity values, whereas it is difficult to reach high resistivity values with previously known compositions.

It has further proved to be advantageous if the thermal conductivity of the compositions is high. The compositions according to the invention have higher thermal conductivity than previously known compositions.

An advantageous embodiment for the composition according to the invention may be a case in which the filler is present in such a amount and shape that the mixture below the switching point is composed of separate particles surrounded by the components (1) and (2). This facilitates the design of heating devices in which it is desired to change the shape of the device.

As the electrically relatively non-conducting, crystalline, monomeric substance melting within or near the predetermined narrow temperature interval, substances are used which have high resistivity both in the solid and the molten state.

Substances with a melting point interval of a maximum of 10° C. are preferred; preferably the melting point interval shall not exceed 5° C. It is advantageous if the molecular weight of the substances is less than 1000, preferably less than 500. Especially suitable and preferred substances are organic compounds or mixtures of such compounds which contain polar groups, e.g. carboxylic or alcohol groups. Suitable polar organic compounds, which are excellent to use as relatively non-conducting meltable substances according to the present invention, are, for example, carboxylic acids, esters or alcohols. It has been found that such polar organic compounds improve the reproducibility of the temperature-resistivity curves when the mixtures are repeatadly heated and cooled, compared with mixtures with non-polar substances. A further advantage of polar organic compounds is that they are less sensitive to the mixing conditions as such.

As component 2, particles of one or several electrically conducting materials, such particles of metal, e.g. copper, are used. Further there are used particles of electrically conducting metal compounds, e.g. oxides, sulfides and carbides, and particles of carbon, such as soot or graphite, which can be amorphous or crystalline, silicon carbide or other electrically conducting particles. The electrically conducting particles may be in the form of grains, flakes or needles, or they may have other shapes. Several types of conducting particles can also be used as a mixture. Particles of carbon have proved to be suitable. A particularly suitable electrically conducting carbon material is carbon black with a small active surface. The amount of component 2 is determined by the desired resistivity range. Generally the component 2 is used in amounts between 5 and 50 parts by weight per 100 parts by weight of component 1. When metal powder is used, it may be necessary to use larger amounts than 50 parts by weight per 100 parts by weight of component 1.

As component 3, non-conducting powdered, flake-shaped or fibrous fillers which are insoluble in the non-conducting substance, there are used, for example, silica quartz, chalk, finely dispersed silica, such as Aerosil$^R$, short glass fibres, polymeric materials insoluble in component 1, or other inert, insoluble fillers. Especially suitable fillers are fillers which are good thermal conductors, e.g. magnesium oxide.

The mixtures of the components (1), (2) and (3) can be made in various types of mixers, e.g. in a Brabender mixer or a rolling mill. The mixing process is suitably performed at a temperature above the melting point for component (1). One or several heat treatments of the mixtures, after the mixing process to temperatures above the melting point of the meltable substance, causes the temperature-resistivity curves after repeated measurements to coincide to a greater extent than without heat treatments.

The electrical conductors connectable to a voltage source in the self-limiting electrical heating device according to the invention may be of copper, aluminum or other electrical conductor materials and they may be tinned, silver-coated or surface treated in other ways to improve the contact properties, the corrosion resistance and the heat resistance. The conductors can be solid with round, rectangular or other cross-sectional shape. They can also exist in the form of strands, foils, nets, tubes, fabrics or other non-solid shapes.

It is specially advantageous in self-limiting electrical heating devices if the electrical conductors connectable to a voltage source are arranged in parallel, particularly if an even power output per area unit is desired.

The narrow temperature interval within which the resistivity of the electrical resistance material is drasticly changed is a temperature range of about 50° C. at the most, preferably of about 20° C. at the most.

If spacers are used in order to maintain the distance between the electrical conductors connectable to a voltage source, when the electrically non-conducting material is in the molten state, there can be used elements of electrically non-conducting materials, such as glass, asbestos or other inorganic materials, cotton, cellulose, plastics, rubber or other natural or synthetic organic materials.

The distance elements can be incorporated in the electrical resistance material in the form of wire, yarn, net, lattice or foam material. The incorporated distance elements have such a shape or/and packing degree that they alone, or together with the insulating cover, prevent the electrical conductors connectable to a voltage source from changing their relative position when the electrically relatively non-conducting resistance material is in the molten state.

According to one embodiment of the self-limiting electrical heating device according to the present invention, the insulating cover alone may constitute the distance element by the electrical conductors being attached to the cover or by the insulating cover being so shaped that it prevents relative movement between the electrical conductors.

The insulating cover can be of plastic, rubber or consist of other insulating materials, e.g. polyethylene, crosslinked polyethylene, polyvinylchloride, polypropylene, natural rubber, synthetic rubber or other natural or synthetic polymers.

Figure 2:
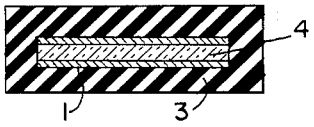
FIGS. 2–4 are embodiments of other heating cables according to the present invention.

In the accompanying drawing, FIG. 1 shows a cross-section of a heating cable according to the present invention, where the distance between the electrical conductors (1), between which an electrical resistance material (2) is positioned, is maintained permanently by an insulating cover (3) which forms the spacer;

FIG. 2 shows a cross-section of a heating cable according to the invention, where the spacer in the form of glass fibre fabric is incorporated in the electrical resistance material (4).

Figure 3:
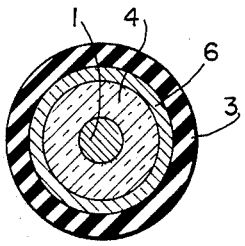
Figure 4:
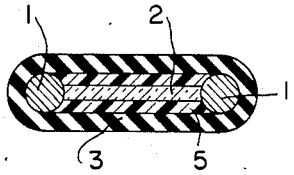

FIG. 3 shows a cross-section of a heating cable according to the invention, where the outer conductor (6) is formed by a copper foil and where the spacer in the form of glass fibre fabric has been incorporated in the electrical resistance material (4); and FIG. 4 shows a cross-section of a heating cable according to the invention, where a plastic profile (5) forms the spacer.

Figure 5:
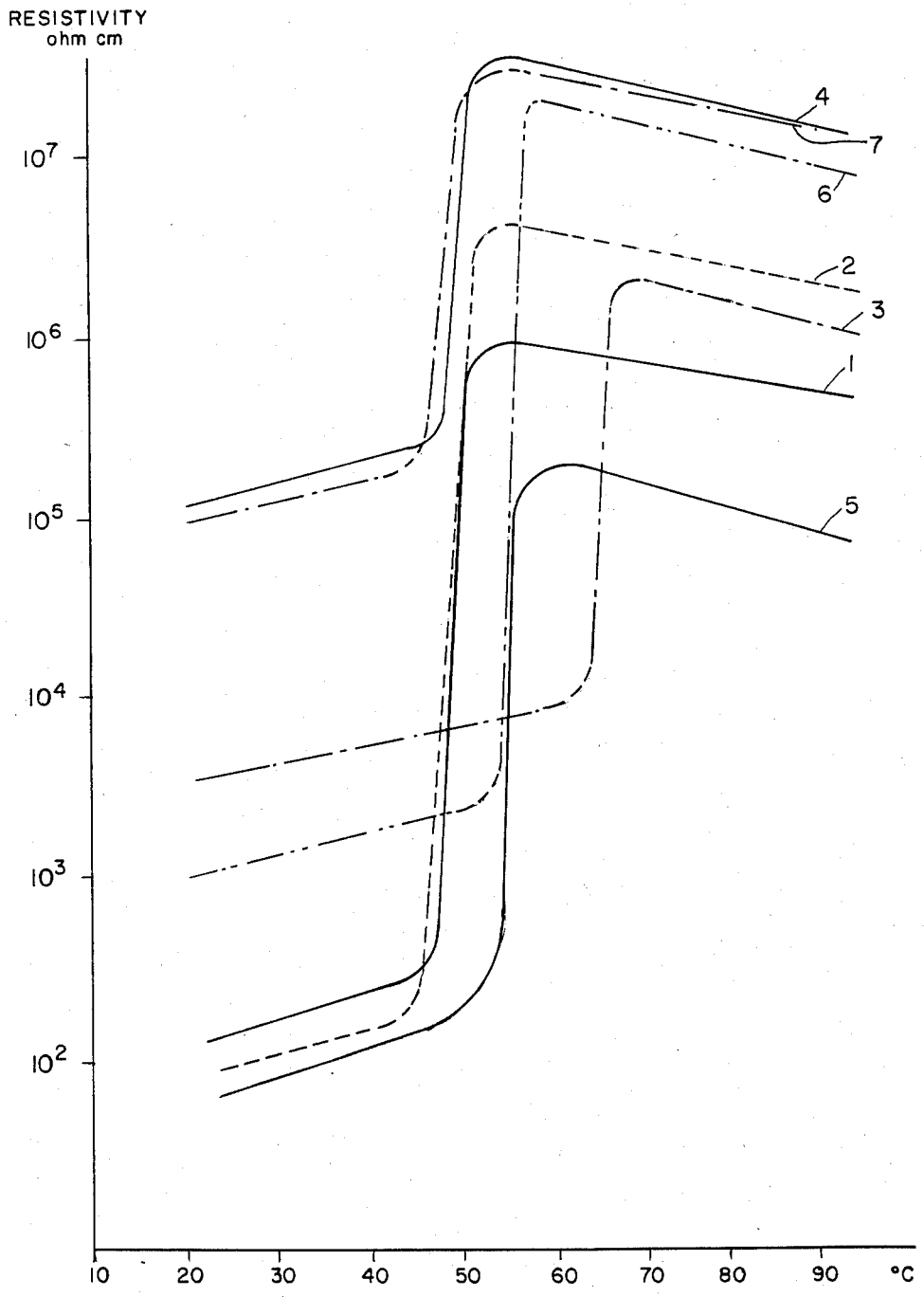
FIGS. 5 and 6 are curves showing results for Examples 1–14.
Figure 6:
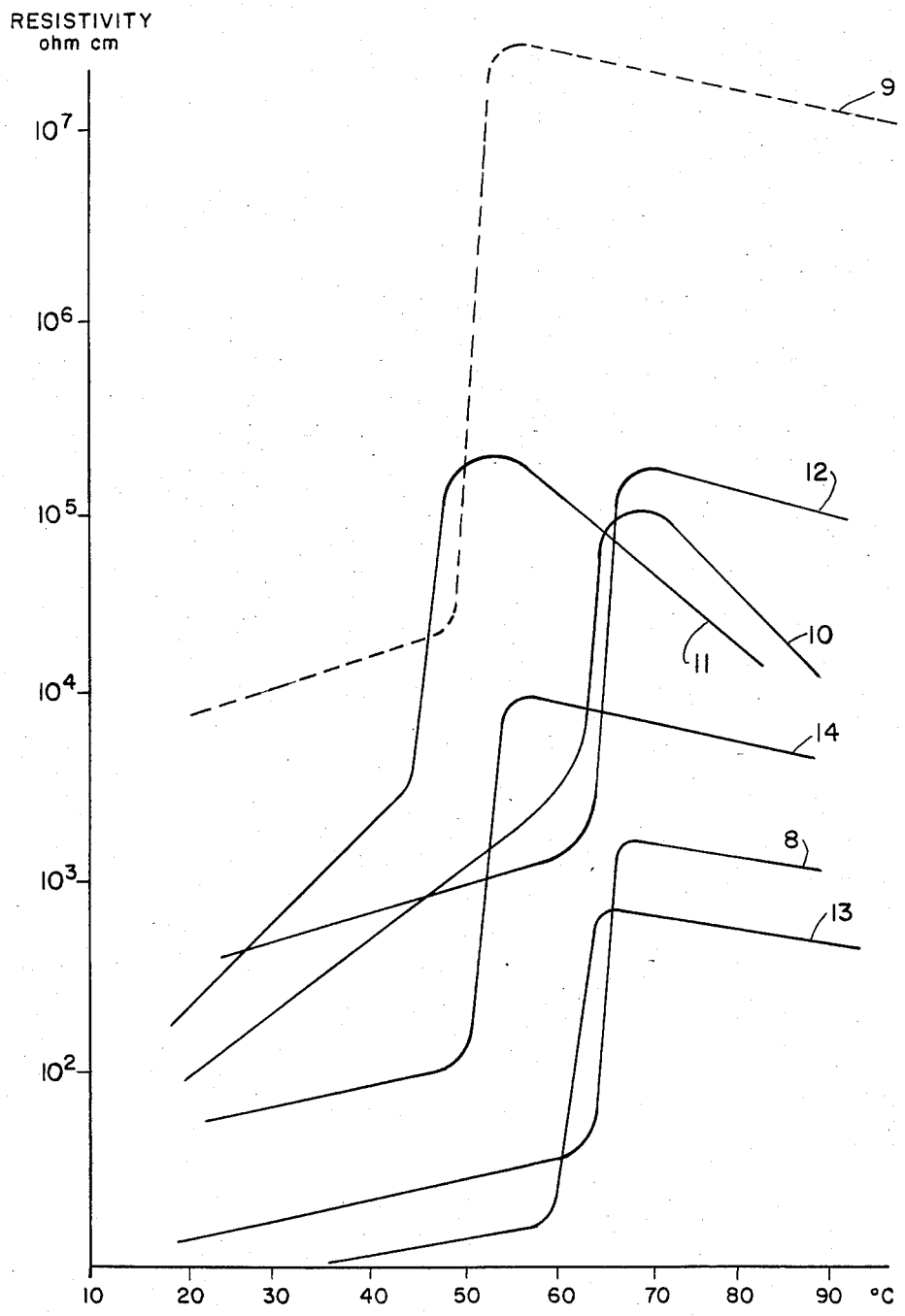

FIGS. 5 and 6 show curves which have been measured in the examples 1–14 for the relationship resistivity-temperature.

The invention will be further illustrated by way of the following examples. The procedures in examples 1–14 were as follows:

The components were mixed in a Brabender mixer for 30 minutes at a temperature above the melting point of component (1). The temperature-resistivity curves were determined on a rectangular sample with silver electrodes on two opposite sides, whereby everything was enclosed in a stiff insulating plastic cover. The mean value of the last two out of three temperature cycles is described with the exception of example 11 (example of comparison), where the third cycle is described. Printex 300, Corax L and Flammruss 101 are different carbon black qualities.

EXAMPLE 1

Stearyl alcohol: 100 parts by weight
Polyamide (11) powder, Rilsan: 200 parts by weight
Printex 300 from Degussa: 17.5 parts by weight

EXAMPLE 2

Mixture 1 after ageing for 10 days 90° C.

EXAMPLE 3

Stearic acid: 100 parts by weight
Aesosil 200 from Degussa: 15 parts by weight
Printex 300: 15 parts by weight

EXAMPLE 4

Stearyl alcohol: 100 parts by weight
Magnesium oxide: 150 parts by weight
Printex 300: 17.5 parts by weight

EXAMPLE 5

Stearic acid: 100 parts by weight
Myanit Dolomit filler "0–10": 400 parts by weight
Flammruss 101 from Degussa: 50 parts by weight

EXAMPLE 6

Stearic acid: 100 parts by weight
Aerosil 200: 11 parts by weight
Grafit W-95 from Grafitwerk Kropfmuhl: 30 parts by weight

EXAMPLE 7

Stearyl alcohol: 100 parts by weight
Polymamide 11 powder: 600 parts by weight
Printex 300: 17.5 parts by weight

EXAMPLE 8

Stearic acid: 100 parts by weight
Silica quartz powder: 250 parts by weight
Corax L from Degussa: 20 parts by weight

EXAMPLE 9

Stearyl alcohol: 100 parts by weight
Polyamide 11 powder: 400 parts by weight
Printex 300: 17.5 parts by weight EXAMPLE 10 (comparison)

Stearic acid: 100 parts by weight
Printex 300: 15 parts by weight

EXAMPLE 11 (comparison)

Paraffin, melting point 48°–52° C. 100 parts by weight
Flammruss 101: 20 parts by weight

EXAMPLE 12

Stearic acid: 100 parts by weight
Silica quartz powder: 150 parts by weight
Polyamide 11 powder: 100 parts by weight
Printex 300: 17.5 parts by weight

EXAMPLE 13

Stearic acid: 100 parts by weight
Silica quartz powder: 300 parts by weight
Grafit W-95: 20 parts by weight
Printex 300: 8 parts by weight

EXAMPLE 14

Stearyl alcohol: 100 parts by weight
PTFE powder F-510 from Allied Chemical: 200 parts by weight
Printex 300: 17.5 parts by weight

EXAMPLE 15

Between 2 copper foils, 100×100 mm, there were placed several layers of a glass-fibre fabric impregnated with a mixture of 100 parts by weight of methyl stearate, 15 parts of weight of Grafit W-95 and 400 parts os weight of chalk. The distance between the copper foils was 10 mm. The copper foils were connected to an electrical voltage source of 220 V, whereby the laminate was heated. The surface temperature rose to about 35° C. and remained constantly at this value. The current intensity varied depending on how the laminate was cooled.

EXAMPLE 16

A cable having a length of 3 m and a cross-section according to FIG. 2 and where the distance between the conductors was 15 mm, the thickness of the conducting layer 1 mm and its composition the same as in example 9, was connected to an electrical voltage source of 220 V. The current intensity was 0.5 A when switching on the cable. The cable was put into a heating chamber with a temperature of 60° C. The current intensity was less than 1 mA, showing that the resistance between the conductors in the cable had risen to above 200,000 ohms, the resistivity of the resistance material had increased by about 500 times its value at room temperature.

EXAMPLE 17

The following compounds were mixed in a Brabender mixer:
Organic compound (see table): 100 parts by weight
Aerosil 200: 4 parts by weight
Silica quartz power: 400 parts by weight
Printex: 17 parts by weight
The switching temperature, that is the temperature of which the resistivity changes by leaps, was determined.

| Organic compound | Switching temperature, °C. |
|---|---|
| Caprylic acid | 12 |
| Capric acid | 25 |
| Lauric acid | 40 |
| Myristic acid | 50 |
| Palmitic acid | 57 |
| Cyclohexanol | 18 |
| Tetradecanol | 30 |
| Methyl stearate | 35 |
| Phenyl stearate | 45 |
| Ethyl palmitate | 20 |

I claim:

1. A self-limiting electrical heating device comprising an electrical resistance material the resistivity of which is changed by more than a power of 10 within a predetermined, narrow temperature interval and which is arranged between electrical conductors connectable to a voltage source, the conductors and the resistance material being enclosed in an electrically insulating cover, characterized in that the electrical resistance material comprises (1) an electrically relatively non-conducting, crystalline, monomeric substance which melts at about the predetermined narrow temperature interval and which constitutes the outer phase, (2) particles of at least one electrically conducting material distributed in the non-conducting material, (3) at least one non-conducting particulate filler said filler being insoluble in the non-conducting material and having a considerably higher melting point than the non-conducting material, similarly distributed in the non-conducting material, whereby the weight ratio between the components (1) and (3) is from 10:90 to 90:10.

2. Heating device according to claim 1, characterized in that component (1), the non-conducting meltable substance, contains polar groups.

3. Heating device according to claim 2, characterized in that the non-conducting meltable substance contains carboxylic acid groups.

4. Heating device according to claim 2, characterized in that the non-conducting meltable substance contains alcohol groups.

5. Heating device according to claim 1, characterized in that it constitutes a heating cable.

6. Heating device according to claim 1 characterized in that it constitutes an electrical wall element.

7. An electrical resistance material, the resistivity of which is changed by more than a power of 10 within a predetermined, narrow temperature interval, for use in self-limiting electrical heating devices, characterized in that the electrical resistance material comprises (1) an electrically relatively non-conducting, crystalline, monomeric substance which melts at about the predetermined narrow temperature interval and which constitutes the outer phase, (2) particles of at least one electrically conducting material, distributed in the non-conducting material, (3) at least one non-conducting particulate filler insoluble in the non-conducting material and having a considerably higher melting point than the non-conducting material, similarly distributed in the non-conducting material, whereby the weight ratio between components (1) and (3) is from 10:90 to 90:10.

8. Heating device according to claim 2, characterized in that it constitutes a heating cable.

9. Heating device according to claim 3, characterized in that it constitutes a heating cable.

10. Heating device according to claim 4, characterized in that it constitutes a heating cable.

11. Heating device according to claim 2, characterized in that it constitutes an electrical wall element.

12. Heating device according to claim 3, characterized in that it constitutes an electrical wall element.

13. Heating device according to claim 4, characterized in that it constitutes an electrical wall element.

14. A self-limiting electrical heating device having an electrical resistance material arranged between electrical conductors connectable to a voltage source, the conductors and resistance material being enclosed in an electrically insulating cover, and wherein said electrical resistance material is the material of claim 7.

15. A self-limiting electrical heating device according to claim 1 having a power development in said electrical resistance material not exceeding 2 watts per $cm^3$.

16. A self-limiting electrical heating device according to claim 1 wherein said electrical resistance material has a resistivity greater than $10^4$ ohm cm.

17. A self-limiting electrical heating device according to claim 1 wherein said electrical resistance material has a melting point interval not exceeding 5° C.

18. A self-limiting electrical heating device in accordance with claim 1 wherein said electrically relatively non-conducting, crystalline, monomeric substance has a molecular weight less than 500.

19. A self-limiting electrical heating device according to claim 1 wherein said electrical resistance material has a power development not exceeding 5 watts per $cm^3$, a resistivity greater than $10^3$ ohm CM, and a melting point interval of no more than 10° C., and said electrically relatively non-conducting, crystalline, monomeric substance has a melecular weight which is less than 1,000.

* * * * *